US008246487B1

(12) United States Patent
Cackett et al.

(10) Patent No.: US 8,246,487 B1
(45) Date of Patent: Aug. 21, 2012

(54) IRON-TYPE GOLF CLUB HEAD HAVING MOVABLE WEIGHTS

(75) Inventors: Matthew T. Cackett, San Diego, CA (US); William C. Watson, Temecula, CA (US); D. Clayton Evans, San Marcos, CA (US); Alan Hocknell, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 40 days.

(21) Appl. No.: 12/872,902

(22) Filed: Aug. 31, 2010

Related U.S. Application Data

(60) Provisional application No. 61/238,925, filed on Sep. 1, 2009.

(51) Int. Cl.
*A63B 53/04* (2006.01)
*A63B 53/06* (2006.01)

(52) U.S. Cl. ..... 473/334; 473/335; 473/337; 473/350; 473/291

(58) Field of Classification Search ..... 473/324–350, 473/287–292
See application file for complete search history.

(56) References Cited

U.S. PATENT DOCUMENTS

| | | | | | |
|---|---|---|---|---|---|
| 2,155,830 | A * | 4/1939 | Howard | 473/246 |
| 4,325,553 | A * | 4/1982 | Taylor | 473/337 |
| 4,540,178 | A * | 9/1985 | Johnson et al. | 473/335 |
| 4,664,383 | A | 5/1987 | Aizawa et al. | |
| 4,667,963 | A | 5/1987 | Yoneyama | |
| 4,792,139 | A | 12/1988 | Nagasaki et al. | |
| 4,798,383 | A | 1/1989 | Nagasaki et al. | |
| 4,848,747 | A | 7/1989 | Fujimura et al. | |
| 4,884,812 | A | 12/1989 | Nagasaki et al. | |
| 4,928,972 | A | 5/1990 | Nakanishi et al. | |
| 4,964,640 | A | 10/1990 | Nakanishi et al. | |
| 5,190,290 | A | 3/1993 | Take | |
| 5,228,694 | A | 7/1993 | Okumoto et al. | |
| 5,297,794 | A * | 3/1994 | Lu | 473/337 |
| 5,326,106 | A | 7/1994 | Meyer | |
| 5,385,348 | A * | 1/1995 | Wargo | 473/338 |
| 5,411,264 | A | 5/1995 | Oku | |
| 5,429,356 | A * | 7/1995 | Dingle et al. | 473/251 |
| 5,472,201 | A | 12/1995 | Aizawa et al. | |
| 5,683,309 | A * | 11/1997 | Reimers | 473/337 |
| 6,015,354 | A * | 1/2000 | Ahn et al. | 473/256 |
| 6,019,686 | A * | 2/2000 | Gray | 473/313 |
| 6,077,173 | A * | 6/2000 | Stites | 473/334 |
| 6,290,609 | B1 * | 9/2001 | Takeda | 473/335 |
| 6,607,452 | B2 | 8/2003 | Helmstetter et al. | |
| 6,857,973 | B2 * | 2/2005 | Wieland et al. | 473/342 |
| 7,108,611 | B2 * | 9/2006 | MacIlraith | 473/288 |
| 7,201,669 | B2 * | 4/2007 | Stites et al. | 473/337 |
| 2006/0084527 | A1 * | 4/2006 | Nycum et al. | 473/350 |
| 2007/0149316 | A1 * | 6/2007 | Nishino | 473/335 |

* cited by examiner

*Primary Examiner* — Sebastiano Passaniti
(74) *Attorney, Agent, or Firm* — Michael A. Catania; Rebecca Hanovice; Sonia Lari

(57) ABSTRACT

An iron-type golf club head is disclosed herein. The iron-type golf club head has multiple movable mass members which allow for the center of gravity to be moved at least 0.170 inch in a feel to toe direction and 0.070 inch in a crown to sole direction. Each of the movable mass members is preferably composed of a material having a density ranging from 12 g/cm$^3$ and 14 g/cm$^3$.

10 Claims, 10 Drawing Sheets

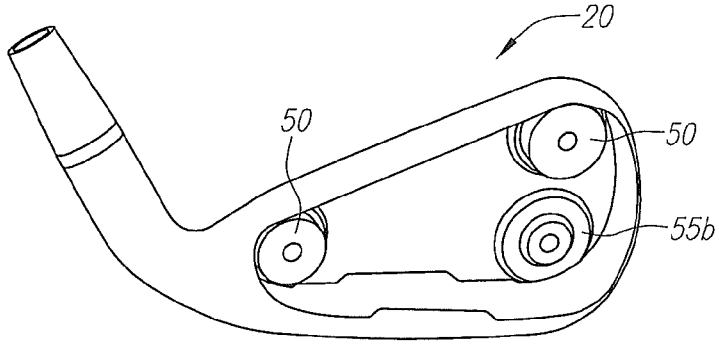

FIG. 8

Impact Loft: 30.000
Design Loft: 30.000
Lie: 62.000
Bulge: No Value
Roll: No Value
Face Angle: -0.000
F1: 2.825

Total Mass: 257.140

Head Frame Mass Properties:
CGX, CGY, CGZ: 0.4785, 1.4484, 0.7333
IXX, IYY, IZZ: 2695.44, 651.44, 2387.56
IXY, IXZ, IYZ: 327.39, 139.36, 70.00

Hosel Frame Mass Properties:
CGX, CGY, CGZ: -2.8756, 1.6231, -0.4785
IXX, IYY, IZZ: 2062.95, 976.05, 2695.44
IXY, IXZ, IYZ: -680.51, 30.66, -354.49

Impact Frame Mass Properties:
CGX, CGY, CGZ: 0.1580, -0.1016, 0.1007
IXX, IYY, IZZ: 2739.15, 651.44, 2343.85
IXY, IXZ, IYZ: 248.52, -63.64, 224.32

Impact Center X, Y, Z: 0.2913, 1.5500, 0.7250
Bulge Roll Apex: X, Y, Z: 0.2913, 1.5500, 0.7250

| Component Weight Breakdown: Solid Name | Weight (g) | Density (g/cu in) | Layer |
|---|---|---|---|
| 1-HEAD | 226.26 | 127.000 | 160 |
| 2- | 9.90 | 127.000 | 160 |
| 3- | 9.90 | 127.000 | 160 |
| 4-SHAFT_SLEEVE | 6.19 | 45.900 | 62 |
| 5-SPLINE_TUBE | 3.05 | 45.900 | 62 |
| 6-SCREW | 1.52 | 110.000 | 62 |
| 7-HELICOIL | 0.23 | 40.000 | 62 |
| 8-EPOXY_SPLINE_TUBE | 0.17 | 24.600 | 62 |

FIG. 8A

FIG. 9

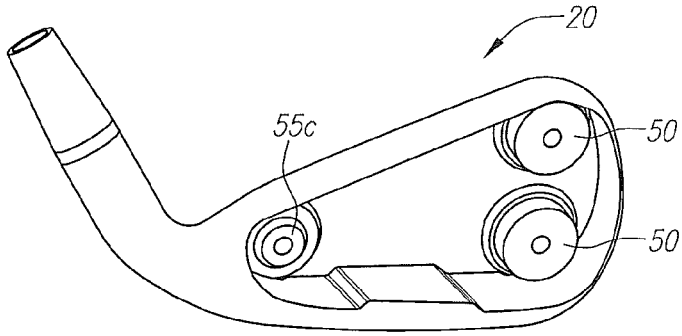

Impact Loft: 30.000
Design Loft: 30.000
Lie: 62.000
Bulge: No Value
Roll: No Value
Face Angle: -0.000
F1: - 2.825

Total Mass: 257.140

Head Frame Mass Properties:
CGX, CGY, CGZ: 0.4814, 1.5320, 0.7356
IXX, IYY, IZZ: 2728.91, 652.88, 2422.80
IXY, IXZ, IYZ: 351.02, 139.91, 67.56

Hosel Frame Mass Properties:
CGX, CGY, CGZ: -2.8947, 1.6980, -0.4814
IXX, IYY, IZZ: 2088.72, 986.97, 2728.91
IXY, IXZ, IYZ: -695.89, 41.26, -375.62

Impact Frame Mass Properties:
CGX, CGY, CGZ: 0.1593, -0.0180, 0.1043
IXX, IYY, IZZ: 2773.55, 652.88, 2378.17
IXY, IXZ, IYZ: 270.21, -62.59, 234.02

Impact Center X, Y, Z: 0.2913, 1.5500, 0.7250
Bulge Roll Apex: X, Y, Z: 0.2913, 1.5500, 0.7250

| Component Weight Breakdown: Solid Name | Weight (g) | Density (g/cu in) | Layer |
|---|---|---|---|
| 1-HEAD | 226.26 | 127.000 | 160 |
| 2- | 9.90 | 127.000 | 160 |
| 3- | 9.90 | 127.000 | 160 |
| 4-SHAFT_SLEEVE | 6.19 | 45.900 | 62 |
| 5-SPLINE_TUBE | 3.05 | 45.900 | 62 |
| 6-SCREW | 1.52 | 110.000 | 62 |
| 7-HELICOIL | 0.23 | 40.000 | 62 |
| 8-EPOXY_SPLINE_TUBE | 0.17 | 24.600 | 62 |

FIG. 9A

FIG. 10

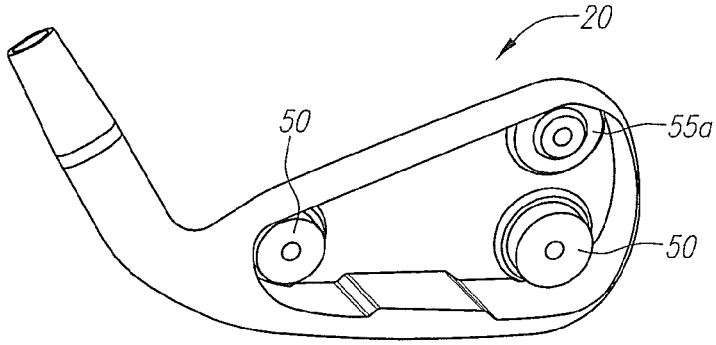

Impact Loft: 30.000
Design Loft: 30.000
Lie: 62.000
Bulge: No Value
Roll: No Value
Face Angle: -0.000
F1: 2.825

Total Mass: 257.140

Head Frame Mass Properties:
CGX, CGY, CGZ: 0.4621, 1.4504, 0.7023
IXX, IYY, IZZ: 2659.26, 584.19, 2372.11
IXY, IXZ, IYZ: 295.46, 105.76, 8.62

Hosel Frame Mass Properties:
CGX, CGY, CGZ: -2.8858, 1.6103, -0.4621
IXX, IYY, IZZ: 1985.19, 971.11, 2659.26
IXY, IXZ, IYZ: -736.30, 45.33, -310.53

Impact Frame Mass Properties:
CGX, CGY, CGZ: 0.1592, -0.0996, 0.0657
IXX, IYY, IZZ: 2679.07, 584.19, 2352.30
IXY, IXZ, IYZ: 251.57, -71.46, 155.20

Impact Center X, Y, Z: 0.2913, 1.5500, 0.7250
Bulge Roll Apex: X, Y, Z: 0.2913, 1.5500, 0.7250

| Component Weight Breakdown: Solid Name | Weight (g) | Density (g/cu in) | Layer |
|---|---|---|---|
| 1-HEAD | 226.26 | 127.000 | 160 |
| 2- | 9.90 | 127.000 | 160 |
| 3- | 9.90 | 127.000 | 160 |
| 4-SHAFT_SLEEVE | 6.19 | 45.900 | 62 |
| 5-SPLINE_TUBE | 3.05 | 45.900 | 62 |
| 6-SCREW | 1.52 | 110.000 | 62 |
| 7-HELICOIL | 0.23 | 40.000 | 62 |
| 8-EPOXY_SPLINE_TUBE | 0.17 | 24.600 | 62 |

FIG. 10A

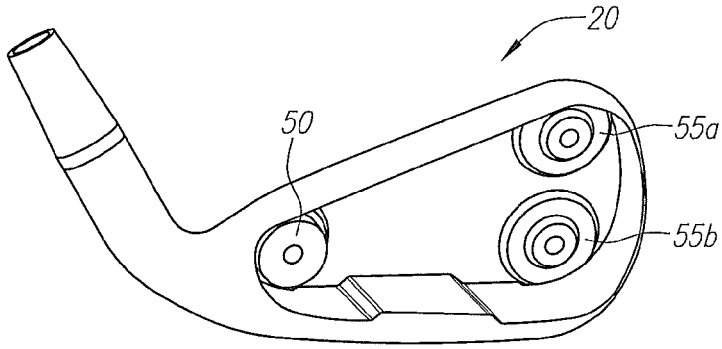

FIG. 11

Model Desc: heel ofis
Impact Loft: 30.000
Design Loft: 30.000
Lie: 62.000
Bulge: No Value
Roll: No Value
Face Angle: -0.000
F1: 2.825

Total Mass: 257.010

Head Frame Mass Properties:
CGX, CGY, CGZ: 0.4591, 1.3672, 0.6999
IXX, IYY, IZZ: 2601.93, 582.08, 2313.20
IXY, IXZ, IYZ: 268.79, 104.88, 6.15

Hosel Frame Mass Properties:
CGX, CGY, CGZ: -2.8489, 1.5358, -0.4591
IXX, IYY, IZZ: 1936.76, 958.53, 2601.93
IXY, IXZ, IYZ: -714.14, 33.58, -286.57

Impact Frame Mass Properties:
CGX, CGY, CGZ: 0.1597, -0.1828, 0.0622
IXX, IYY, IZZ: 2620.58, 582.08, 2294.55
IXY, IXZ, IYZ: 229.70, -72.58, 139.72

Impact Center X, Y, Z: 0.2913, 1.5500, 0.7250
Bulge Roll Apex: X, Y, Z: 0.2913, 1.5500, 0.7250

| Component Weight Breakdown: Solid Name | Weight (g) | Density (g/cu in) | Layer |
|---|---|---|---|
| 1-HEAD | 226.26 | 127.000 | 160 |
| 2- | 9.90 | 127.000 | 160 |
| 3- | 9.90 | 127.000 | 160 |
| 4-SHAFT_SLEEVE | 6.19 | 45.900 | 62 |
| 5-SPLINE_TUBE | 3.05 | 45.900 | 62 |
| 6-SCREW | 1.52 | 110.000 | 62 |
| 7-HELICOIL | 0.23 | 40.000 | 62 |
| 8-EPOXY_SPLINE_TUBE | 0.17 | 24.600 | 62 |

FIG. 11A

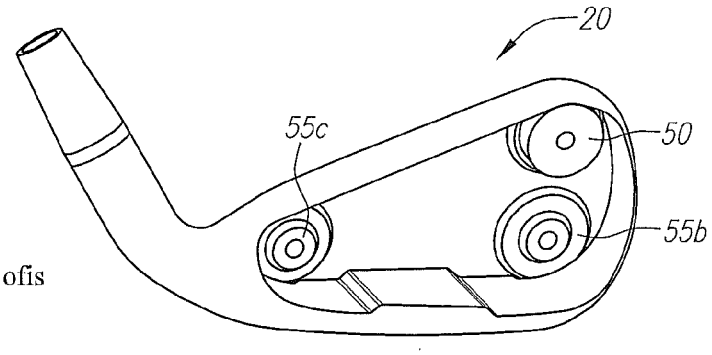

FIG. 12

Model Desc: High toe ofis
Impact Loft: 30.000
Design Loft: 30.000
Lie: 62.000
Bulge: No Value
Roll: No Value
Face Angle: -0.000
F1: 2.825

Total Mass: 257.010

Head Frame Mass Properties:
CGX, CGY, CGZ: 0.4976, 1.5295, 0.7662
IXX, IYY, IZZ: 2760.17, 714.63, 2436.20
IXY, IXZ, IYZ: 380.30, 171.15, 124.07

Hosel Frame Mass Properties:
CGX, CGY, CGZ: -2.8666, 1.7101, -0.4976
IXX, IYY, IZZ: 2159.62, 991.21, 2760.17
IXY, IXZ, IYZ: -644.24, 27.42, -416.13

Impact Frame Mass Properties:
CGX, CGY, CGZ: 0.1580, -0.0205, 0.1388
IXX, IYY, IZZ: 2827.40, 714.63, 2368.97
IXY, IXZ, IYZ: 267.31, -54.71, 297.60

Impact Center X, Y, Z: 0.2913, 1.5500, 0.7250
Bulge Roll Apex: X, Y, Z: 0.2913, 1.5500, 0.7250

| Component Weight Breakdown: Solid Name | Weight (g) | Density (g/cu in) | Layer Layer |
|---|---|---|---|
| 1-HEAD | 226.26 | 127.000 | 160 |
| 2- | 9.90 | 127.000 | 160 |
| 3- | 9.90 | 127.000 | 160 |
| 4-SHAFT_SLEEVE | 6.19 | 45.900 | 62 |
| 5-SPLINE_TUBE | 3.05 | 45.900 | 62 |
| 6-SCREW | 1.52 | 110.000 | 62 |
| 7-HELICOIL | 0.23 | 40.000 | 62 |
| 8-EPOXY_SPLINE_TUBE | 0.17 | 24.600 | 62 |

FIG. 12A

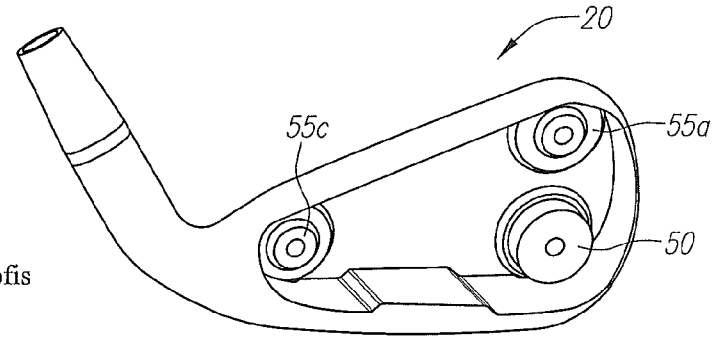

FIG. 13

Model Desc: low toe ofis
Impact Loft: 30.000
Design Loft: 30.000
Lie: 62.000
Bulge: No Value
Roll: No Value
Face Angle: -0.000
F1: 2.825

Total Mass: 257.010

Head Frame Mass Properties:
CGX, CGY, CGZ: 0.4649, 1.5333, 0.7046
IXX, IYY, IZZ: 2690.91, 585.80, 2405.56
IXY, IXZ, IYZ: 321.24, 106.43, 10.37

Hosel Frame Mass Properties:
CGX, CGY, CGZ: -2.9227, 1.6846, -0.4649
IXX, IYY, IZZ: 2013.08, 978.29, 2690.91
IXY, IXZ, IYZ: -748.52, 56.84, -333.61

Impact Frame Mass Properties:
CGX, CGY, CGZ: 0.1605, -0.0167, 0.0692
IXX, IYY, IZZ: 2711.74, 685.80, 2384.72
IXY, IXZ, IYZ: 273.02, -70.34, 169.60

Impact Center X, Y, Z: 0.2913, 1.5500, 0.7250
Bulge Roll Apex: X, Y, Z: 0.2913, 1.5500, 0.7250

| Component Weight Breakdown: Solid Name | Weight (g) | Density (g/cu in) | Layer Layer |
|---|---|---|---|
| 1-HEAD | 226.26 | 127.000 | 160 |
| 2- | 9.90 | 127.000 | 160 |
| 3- | 9.90 | 127.000 | 160 |
| 4-SHAFT_SLEEVE | 6.19 | 45.900 | 62 |
| 5-SPLINE_TUBE | 3.05 | 45.900 | 62 |
| 6-SCREW | 1.52 | 110.000 | 62 |
| 7-HELICOIL | 0.23 | 40.000 | 62 |
| 8-EPOXY_SPLINE_TUBE | 0.17 | 24.600 | 62 |

FIG. 13A

IRON-TYPE GOLF CLUB HEAD HAVING MOVABLE WEIGHTS

CROSS REFERENCES TO RELATED APPLICATIONS

The present application claims priority to U.S. Provisional Patent Application No. 61/238,925, filed on Sep. 1, 2009, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to an iron-type golf club head having movable mass members.

2. Description of the Related Art

The prior art discloses various iron-type golf club heads. Irons are typically composed of a stainless steel or titanium material, and are typically cast or forged. Most golfers desire that their irons have a large sweet spot for greater forgiveness, a low center of gravity to get the ball in the air, a solid sound, reduced vibrations during impact, and a trim top line for appearance. Unfortunately, these desires are often in conflict with each other as it pertains to an iron.

Most existing irons, both those intended for play or for fitting, do not have adjustable weights in the head. Those few that do have adjustable weights have several disadvantages. First, the amount of moveable weight is inadequate to meaningfully affect mass properties in both heel-toe and up-down directions. Second, the weighting elements detract from the visual appeal of the head. For example, the weights can be seen at address and are distracting during a golf swing. Third, the weighting elements detract from the sound or feel at impact with a golf ball. Fourth, the weighting elements loosen during use.

Most iron-type golf club heads are designed with specific mass properties that cannot be adjusted.

One example is U.S. Pat. No. 5,228,694 to Okumoto et al., which discloses an iron club head composed of a stainless steel sole and hosel, a core composed of a bulk molding compound or the like, a weight composed of a tungsten and polyamide resin, and an outer-shell composed of a fiber-reinforced resin.

Another example is set forth in U.S. Pat. Nos. 4,792,139, 4,798,383, 4,792,139 and 4,884,812, all to Nagasaki et al., which disclose an iron club head composed of stainless steel with a fiber reinforced plastic back plate to allow for weight adjustment and ideal inertia moment adjustment.

Another example is U.S. Pat. No. 4,848,747 to Fujimura et al., which discloses a metal iron club head with a carbon fiber reinforced plastic back plate to increase the sweet spot. A ring is used to fix the position of the back plate.

Another example is set forth in U.S. Pat. Nos. 4,928,972 and 4,964,640 to Nakanishi et al., which disclose an iron club head composed of stainless steel with a fiber reinforcement in a rear recess to provide a dampening means for shock and vibrations, a means for increasing the inertial moment, a means for adjusting the center of gravity and a means for reinforcing the back plate.

Another example is U.S. Pat. No. 5,190,290 to Take, which discloses an iron club head with a metal body, a filling member composed of a light weight material such as a plastic, and a fiber-reinforced resin molded on the metal body and the filling member.

Another example is U.S. Pat. No. 5,411,264 to Oku, which discloses a metal body with a backwardly extended flange and an elastic fiber face plate in order to increase the moment of inertia and minimize head vibrations.

Another example is U.S. Pat. No. 5,472,201 to Aizawa et al., which discloses an iron club head with a body composed of stainless steel, a face member composed of a fiber reinforced resin and a protective layer composed of a metal, in order to provide a deep center of gravity and reduce shocks.

Another example is U.S. Pat. No. 5,326,106 to Meyer, which discloses an iron golf club head with a metal blade portion and hosel composed of a lightweight material such as a fiber reinforced resin.

Another example is U.S. Pat. No. 4,664,383 to Aizawa et al., which discloses an iron golf club head with a metal core covered with multiple layers of a reinforced synthetic resin in order to provide greater ball hitting distance.

Another example is U.S. Pat. No. 4,667,963 to Yoneyama, which discloses an iron golf club head with a metal sole and a filling member composed of a fiber reinforced resins material in order to provide greater hitting distance.

The prior art fails to disclose an iron-type golf club head that has a multitude of mass property combinations without the afore-mentioned disadvantages.

BRIEF SUMMARY OF THE INVENTION

The present invention provides a novel solution to overcoming the disadvantages of the prior art.

The present invention comprises an iron-type golf club head with a body substantially lighter than normal (e.g. 232 grams instead of 257 grams for a 6 iron golf club head) with multiple threaded receptacles on the back side of the face for retention of one or more mass members that are selected and positioned to achieve a final head weight similar to normal (e.g. 257 grams). The various combinations of mass members result in a range of different mass properties that can be perceived by a golfer.

One aspect of the present invention is an iron-type golf club head with a center of gravity movement in a heel to toe direction of at least 0.170 inch and a center of gravity movement in a crown to sole direction of at least 0.070 inch. There various examples of mass property variants achievable from the invention based on using different mass weights and different combinations and positions.

Another aspect of the present invention is an iron-type golf club head having a multitude interchangeable mass members located on the back side of the face and threadably engaged.

Another aspect of the present invention is an iron-type golf club head having multiple moveable mass members that are threadably engaged on the back side of the face and which are capable of achieving center of gravity movements of 0.170 inch in a heel-toe direction and 0.070 inch in a crown to sole direction.

Another aspect of the present invention is an iron-type golf club head without the mass members and screws having a mass that is at least 18 grams less than a standard mass for a iron-type golf club head of the same loft.

Another aspect of the present invention is an iron-type golf club head having three threaded blind holes in the back side of the face for attaching between one to three mass members.

Another aspect of the present invention is an iron-type golf club head having mass members that are not visible to the golfer at normal address orientation.

Another aspect of the present invention is an iron-type golf club head having center of gravity movements of 0.170 inch in the heel to toe direction and 0.070 inch in the crown to sole direction that are separately achievable.

Another aspect of the present invention is an iron-type golf club head having a main body and at least one movable mass member. The main body is composed of a first metal material. The main body comprises a front wall, a sole wall, a toe wall extending upward from the sole wall at a first end of the sole wall, a hosel extending upward from the sole wall at a second end of the sole wall, a heel wall extending upward from the sole wall, a top wall extending from an upper end of the toe wall to an upper end of the heel wall. The top wall, the sole wall, the heel wall, the toe wall and the front wall define a rear cavity. The rear cavity has a plurality of threaded projections. The least one mass member is attached to at least one of the plurality of threaded projections in the rear cavity of the main body. The at least one mass member is composed of a second metal material having a density greater than the density of the first metal material of the main body.

The first metal material of the main body preferably has a density between 4 g/cm$^3$ and 10 g/cm$^3$. The at least one mass member has a density ranging from 12 g/cm$^3$ and 14 g/cm$^3$.

The plurality of threaded projections comprises a first threaded projection located at a heel position, a second threaded projection located at a high toe position and a third threaded projection located at a low toe position.

Another aspect of the present invention is an iron-type golf club head having a main body, a first mass member and second mass member. The main body is composed of a first metal material having a density between 4 g/cm$^3$ and 9 g/cm$^3$. The main body comprises a rear wall having a first threaded projection located at a heel position, a second threaded projection located at a high toe position and a third threaded projection located at a low toe position. The first mass member and the second mass member are each separately attached to a threaded projection. The mass members have a density greater than the density of the first metal material of the main body. The center of gravity of the iron-type golf club head can be moved at least 0.170 inch in a heel-to toe direction and at least 0.070 in a crown to sole direction based on the placement of the first mass member and the second mass member.

The main body has a mass of approximately 232 grams and the first mass member and second mass member have a combined mass of 18 grams.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 8 is a rear view of an iron-type golf club head with two movable mass members attached to a rear cavity in a high toe position and heel position.

FIG. 8A is a table of mass properties for an iron-type golf club head with two movable mass members attached to a rear cavity in a high toe position and heel position.

FIG. 9 is a rear view of an iron-type golf club head with two movable mass members attached to a rear cavity in a high toe position and low toe position.

FIG. 9A is a table of mass properties for an iron-type golf club head with two movable mass members attached to a rear cavity in a high toe position and low toe position.

FIG. 10 is a rear view of an iron-type golf club head with two movable mass members attached to a rear cavity in a heel position and low toe position.

FIG. 10A is a table of mass properties for an iron-type golf club head with two movable mass members attached to a rear cavity in a heel position and low toe position.

FIG. 11 is a rear view of an iron-type golf club head with one movable mass member attached to a rear cavity in a heel position.

FIG. 11A is a table of mass properties for an iron-type golf club head with one movable mass member attached to a rear cavity in a heel position.

FIG. 12 is a rear view of an iron-type golf club head with one movable mass member attached to a rear cavity in a high toe position.

FIG. 12A is a table of mass properties for an iron-type golf club head with one movable mass member attached to a rear cavity in a high toe position.

FIG. 13 is a rear view of an iron-type golf club head with one movable mass member attached to a rear cavity in a low toe position.

FIG. 13A is a table of mass properties for an iron-type golf club head with one movable mass member attached to a rear cavity in a low toe position.

DETAILED DESCRIPTION OF THE INVENTION

Figure 1:
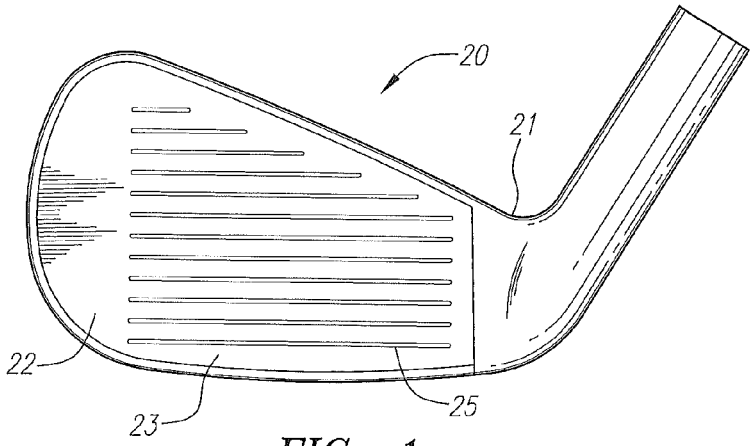
FIG. 1 is a front view of an iron-type golf club head.
Figure 2:
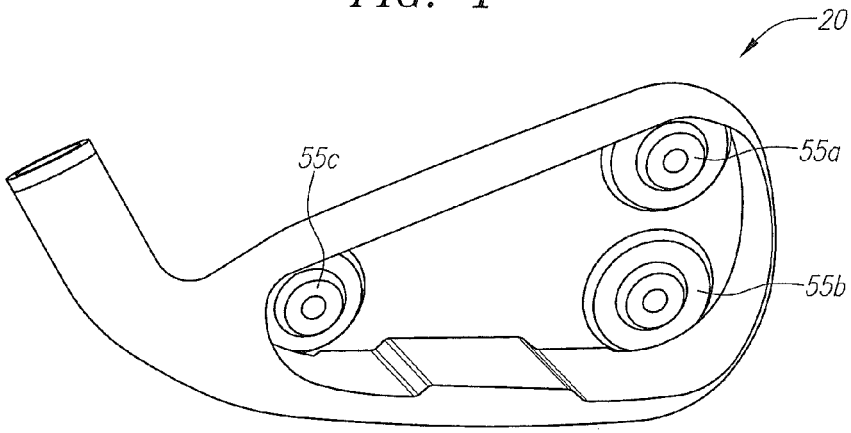
FIG. 2 is a rear view of an iron-type golf club head.
Figure 2A:
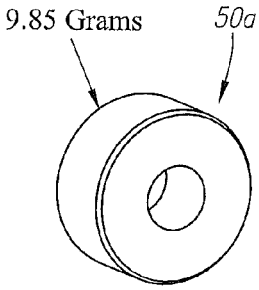
FIG. 2A is a movable mass member used with an iron-type golf club head.
Figure 2B:
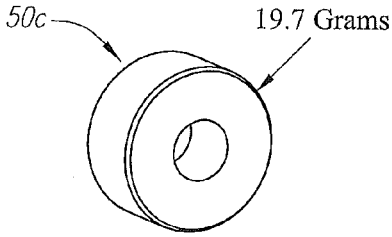
FIG. 2B is a movable mass member used with an iron-type golf club head.
Figure 3:
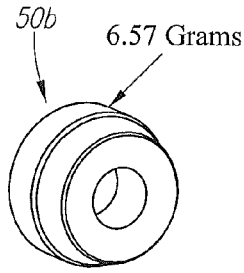
FIG. 3 is a movable mass member used with an iron-type golf club head.
Figure 4:
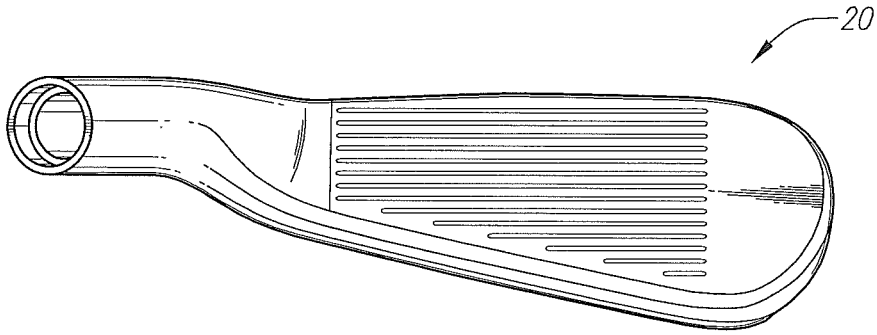
FIG. 4 is a top plan view of an iron-type golf club head.
Figure 5:
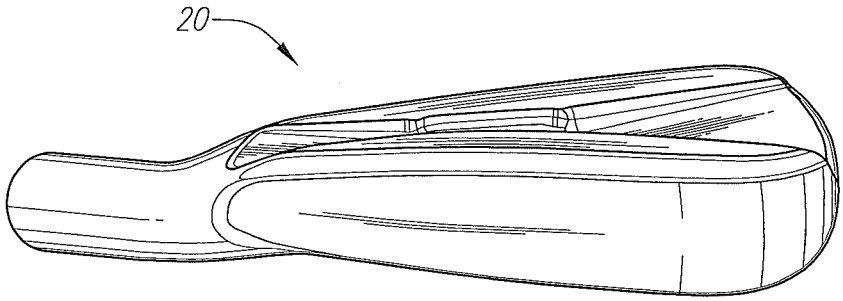
FIG. 5 is a bottom plan view of an iron-type golf club head.
Figure 6:
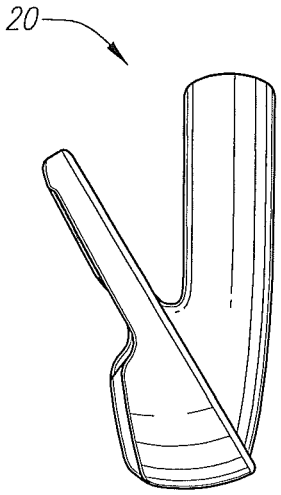
FIG. 6 is a toe side view of an iron-type golf club head.
Figure 7:
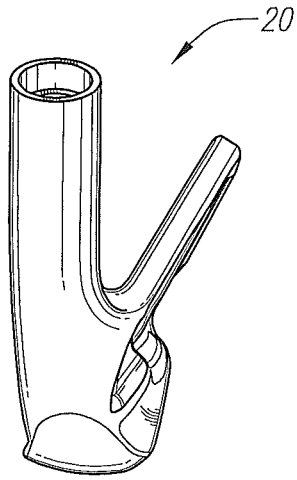
FIG. 7 is a heel side view of an iron-type golf club head.
Figure 14:
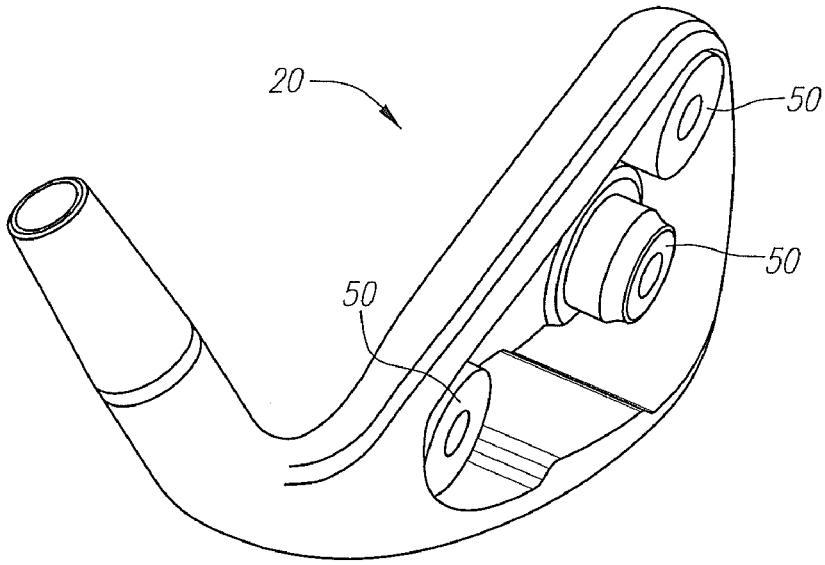
FIG. 14 is a heel side perspective view of an iron-type golf club head with movable mass members.
Figure 15:
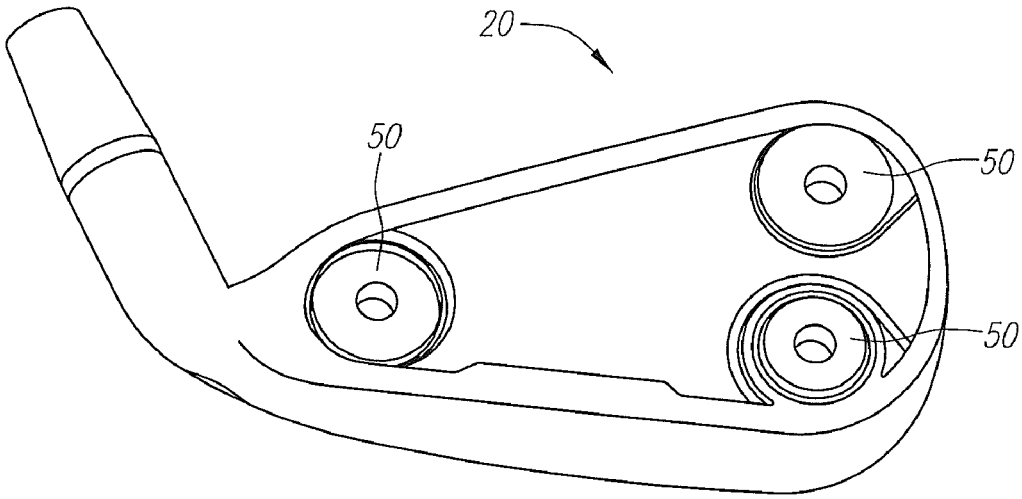
FIG. 15 is a rear plan view of an iron-type golf club head with movable mass members.
Figure 16:
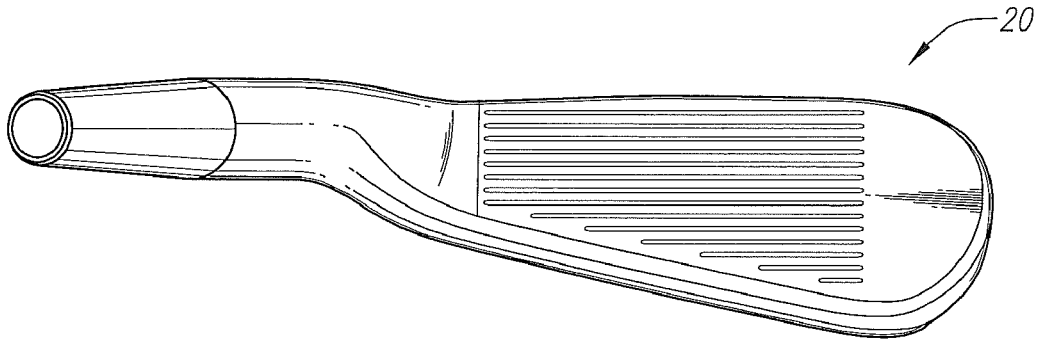
FIG. 16 is a top view of an iron-type golf club head with movable mass members.
Figure 17:
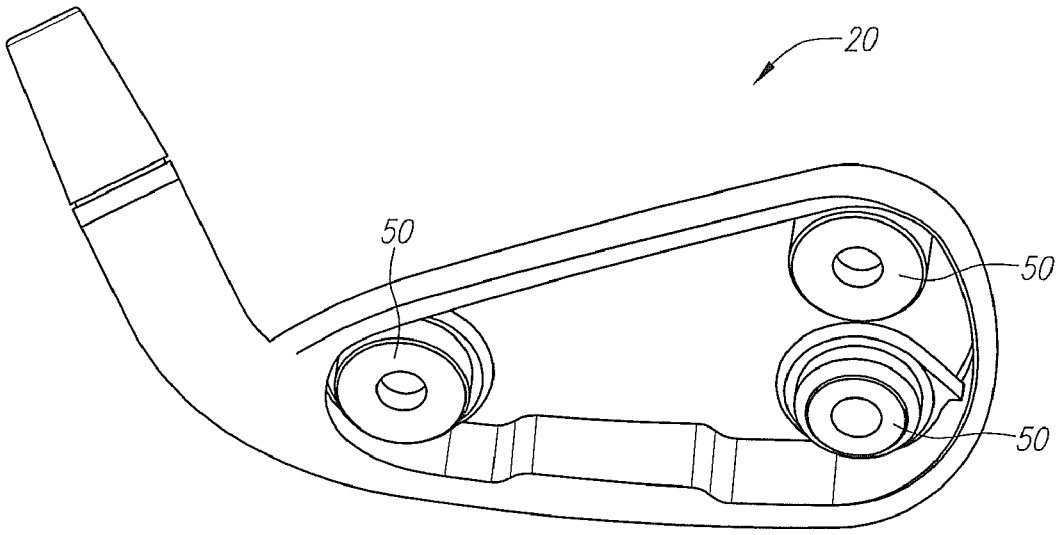
FIG. 17 is a rear top perspective view of an iron-type golf club head with movable mass members.

As shown in FIGS. 1-7 and 14-17, an iron-type golf club is generally designated 20. The golf club head 20 includes a body 21 having a face 22 with a surface 23, a rear recess 30, a plurality of grooves 25, at least one movable mass member 50 and multiple threaded projections 55. The body 21 is preferably composed of a material such as titanium materials, stainless steel, carpenter steel, 1020 steel, amorphous metals and the like. The material of the body 21 preferably has a density between 4 g/cm$^3$ and 10 g/cm$^3$. Such titanium materials include pure titanium and titanium alloys such as 6-4 titanium alloy, 6-22-22 titanium alloy, 4-2 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. The body 21 is preferably manufactured through casting. Alternatively, the body 21 is manufactured through forging, forming, machining, powdered metal forming, metal-injection-molding, electro-chemical milling, and the like.

The body 21 is preferably eighteen grams or more less than a standard iron-type golf club head of the same loft, which allows for mass members and screws having a mass of eighteen grams or more to be utilized to affect the position of the center of gravity of the iron-type golf club head 20.

As demonstrated in FIGS. 8-13A, the positioning and use of the mass members 50 affects the mass properties of the iron-type golf club head 20. A typical iron-type golf club head 20 has three threaded projections 55*a*, 55*b* and 55*c*. At least one movable mass member 50 is attached to one of the threaded projections 55.

The axes of inertia through the center of gravity of the golf club head 20 are designated X, Y and Z. The X axis extends from the front of the golf club head 20 through the center of gravity, CG, at the front wall to the rear of the golf club head 20. The Y axis extends from the heel end of the golf club head 20 through the center of gravity, CG, and to the toe end of the golf club head 20. The Z axis extends from the sole wall through the center of gravity, CG, and to the top line of the golf club head 20.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head 20 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z-axis for the golf club head 20 preferably ranges from 2200 g-cm$^2$ to 3000 g-cm$^2$, more preferably from 2400 g-cm$^2$ to 2700 g-cm$^2$, and most preferably from 2472 g-cm$^2$ to 2617 g-cm$^2$. The moment of inertia, Iyy, about the Y-axis for the golf club head 20 preferably ranges from 400 g-cm$^2$ to 700 g-cm$^2$, more preferably from 500 g-cm$^2$ to 600 g-cm$^2$, and most preferably from 530 g-cm$^2$ to 560 g-cm$^2$. The moment of inertia, Ixx, about the X-axis for the golf club head 20 preferably ranges from 2450 g-cm$^2$ to 3200 g-cm$^2$, more preferably from 2500 g-cm$^2$ to 2900 g-cm$^2$, and most preferably from 2650 g-cm$^2$ to 2870 g-cm$^2$.

For comparison, the new BIG BERTHA® 5-iron from Callaway Golf Company has a moment of inertia, Izz, of 2158 g-cm$^2$, a moment of inertia, Iyy, of 585 g-cm$^2$, and a moment of inertia, Ixx, of 2407 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. An iron-type golf club head comprising:

a main body composed of a first metal material, the main body comprising a front wall, a sole wall, a toe wall extending upward from the sole wall at a first end of the sole wall, a hosel extending upward from the sole wall at a second end of the sole wall, a heel wall extending upward from the sole wall, a top wall extending from an upper end of the toe wall to an upper end of the heel wall, the top wall, the sole wall, the heel wall, the toe wall and the front wall defining a rear cavity, the rear cavity having a plurality of threaded projections projecting from a rear surface of the front wall, the plurality of threaded projections comprising a heel threaded projection, an upper toe threaded projection and a lower toe threaded projection, wherein the first metal material of the main body has a density between 4 g/cm$^3$ and 10 g/cm$^3$; and at least one mass member attached to at least one of the plurality of threaded projections in the rear cavity of the main body, the at least one mass member a heel mass member attached to the heel threaded projection, an upper toe mass member attached to the upper toe threaded projection and a lower toe mass member attached to the lower toe threaded projection, each of the heel mass member, the upper toe mass member and the lower toe mass member composed of a second metal material having a density ranging from 12 g/cm$^3$ and 14 g/cm$^3$ and greater than the density of the first metal material of the main body.

2. The iron golf club head according to claim 1 wherein the first metal material of the main body is a stainless steel.

3. The iron golf club ahead according to claim 1 wherein the at least one mass member is composed of a tungsten, iron, chromium alloy.

4. The iron golf club head according to claim 1 wherein the club head has a moment of inertia Ixx through the center of gravity of at least 2600 g-cm$^2$ and a moment of inertia Izz through the center of gravity of at least 2400 g-cm$^2$.

5. The iron golf club head according to claim 1 wherein the at least one mass member is composed of a stainless steel material.

6. The iron golf club head according to claim 1 wherein the first metal material of the main body is a titanium alloy.

7. An iron golf club head comprising:

a main body composed of a first metal material having a density between 4 g/cm$^3$ and 9 g/cm$^3$, the main body comprising a front wall, a sole wall, a toe wall extending upward from the sole wall at a first end of the sole wall, a hosel extending upward from the sole wall at a second end of the sole wall, a heel wall extending upward from the sole wall, a top wall extending from an upper end of the toe wall to an upper end of the heel wall, the top wall, the sole wall, the heel wall, the toe wall and the front wall defining a rear cavity, a rear surface of the front wall having a first threaded projection located at a heel position, a second threaded projection located at a high toe position and a third threaded projection located at a low toe position, wherein the first threaded projection, the second threaded projection and the third threaded projection projecting from the rear surface of the front wall; and a first mass member, a second mass member, a third mass member, each separately attached to a threaded projection, each mass member having a density greater than each of the density of the first metal material of the main body, and a density ranging from 12 g/cm$^3$ and 14 g/cm$^3$;

wherein the center of gravity of the iron-type golf club head can be moved at least 0.170 inch in a heel-to toe direction and at least 0.070 in a crown to sole direction based on the placement of the first mass member, the second mass member and the third mass member;

wherein the main body has a mass of approximately 232 grams, and the first mass member, the second mass member and the third mass member have a combined mass of 18 grams.

8. The iron golf club head according to claim 7 wherein the first metal material of the main body is a stainless steel.

9. The iron golf club head according to claim 7 wherein the club head has a moment of inertia Ixx through the center of gravity of at least 2600 g-cm$^2$ and a moment of inertia Izz through the center of gravity of at least 2400 g-cm$^2$.

10. The iron golf club head according to claim 7 wherein the mass members are not visible at address.

* * * * *